US007641366B1

(12) United States Patent
Sibalich et al.

(10) Patent No.: US 7,641,366 B1
(45) Date of Patent: Jan. 5, 2010

(54) DUAL MOUNT LANTERN

(75) Inventors: Gregory L. Sibalich, Bowling Green, KY (US); Lam Kai Kuong, Kowloon (HK)

(73) Assignee: HeathCo LLC, Elmhurst, IL (US)

( * ) Notice: Subject to any disclaimer, the term of this patent is extended or adjusted under 35 U.S.C. 154(b) by 277 days.

(21) Appl. No.: 11/677,810

(22) Filed: Feb. 22, 2007

(51) Int. Cl.
*F21V 21/14* (2006.01)

(52) U.S. Cl. ..... 362/371; 362/418; 362/287; 362/276

(58) Field of Classification Search ..... 362/147, 362/418, 427, 428, 430, 287, 802, 276
See application file for complete search history.

(56) References Cited

U.S. PATENT DOCUMENTS 1,676,254 A * 7/1928 Despard ..... 200/51.14
5,941,630 A * 8/1999 Finke et al. ..... 362/371
6,257,743 B1 7/2001 Ursch
6,439,750 B2 * 8/2002 Klaus et al. ..... 362/418
6,848,813 B2 * 2/2005 Patz et al. ..... 362/432

* cited by examiner

*Primary Examiner*—Ali Alavi
(74) *Attorney, Agent, or Firm*—Fitch Even Tabin & Flannery

(57) ABSTRACT

A lighting fixture capable of mounting in a plurality of orientations comprises a wall mount assembly having a front canopy rotatably secured to a rear canopy and a lamp housing assembly capable of a plurality of orientations secured to said rotatable front canopy and capable of rotation therewith. The lamp housing assembly may further include a motion sensor integral thereto whereby the rotation of the housing assembly does not affect the performance of the motion sensor.

30 Claims, 7 Drawing Sheets

DUAL MOUNT LANTERN

BACKGROUND OF THE INVENTION

1. Field of the Invention

The present invention relates generally to a lamp assembly that may be mounted in a plurality of orientations on a mounting surface, and more specifically to a lamp assembly having a motion sensor integral thereto that is capable of being oriented in multiple positions without affecting the operation of the motion sensor.

2. Description of the Related Art

A variety of prior art lighting fixtures utilize canopies of molded plastic or metal materials which are mounted to wall surfaces or the like, and through which power wiring is routed. Often these fixtures incorporate canopies that are secured to a surface by a plurality of fasteners engaging both the canopy and a mounting plate that is otherwise secured to a mounting surface. Many known in the art mounting plates employ slot arrangements for mounting lighting fixtures thereto that permit a plurality of mounting orientations such that fixtures can be adjusted slightly when mounted.

Some prior art fixture systems include lamp housings that are capable of being mounted, from an aesthetic standpoint, in a plurality of orientations. One difficulty with many of these systems is the inability to change the orientation of the fixture once the fixture is mounted, without the necessity of removing wiring connections, mounting hardware, and the like. Once the fixture is mounted, it becomes quite troublesome to rearrange its orientation.

Furthermore, in many modern outdoor lighting fixtures, motion sensors are employed within the sensor housing to detect motion in a field of view proximate thereto, and illuminate the fixture lamp responsive to detected motion. However, changing the orientation of motion sensor fixtures is particularly vexing, since the field of view of the motion sensor is often undesirably altered when the fixture orientation is changed.

Accordingly, there is a need for a lighting fixture that may be mounted in a plurality of orientations with no required hardware or tools, and further, for a lighting fixture employing a motion sensor or the like that may be mounted in multiple orientations without appreciably altering the field of view of the sensor.

SUMMARY OF THE INVENTION

The present invention addressed the aforementioned problems by providing a lighting fixture capable of being mounted in a plurality of orientations on a mounting surface without affecting the fixture's performance. The invention includes a lamp housing having an integral motion sensor arranged therein to maintain a properly oriented field of view for detecting motion regardless of the orientation of the fixture. The lamp housing is capable of rotation around a central axis and may include a motion sensor, for example a pyroelectric infrared sensor (PIR) that is covered by a Fresnel lens to focus impinging infrared energy on the PIR sensor The PIR sensor and lens comprise a sensor assembly that is positioned in the lamp housing proximate the axis of rotation so that when rotated, the sensor assembly has moved in a vertical plane very little. This feature of the invention provides for a rotatable lantern utilizing a motion sensor control that does not have to be carefully reoriented when the lamp is reoriented. The motion sensor maintains a field of view optimized for the detection of motion when the lantern is mounted, despite its orientation.

The invention further includes a wall mount assembly that is readily secured to a structure to support the lamp housing, and to which the lamp housing is secured. The wall mount assembly incorporates a rotating bracket that enables the rotation of the lamp housing around an axis that is generally orthogonal to the wall or structure to which the wall mount assembly is secured.

The rotating bracket incorporates a two-piece plate construction, the plates being rotatable with respect to each other about a central aperture therein. The wall mount assembly further includes a front canopy to which the lamp housing is secured, and a rear canopy that includes a recessed portion therein for accepting an electronic control assembly required to interface with the motion sensor and lamp. Front and rear canopies are secured together by securing one of each to the rotating bracket plates, thereby providing for a front canopy and lamp housing that rotates with respect to the rear canopy and wall mount.

Furthermore, the rear canopy may include a plurality of switch apertures for access to various control switches extending from the electronic control assembly recessed therein. In this feature of the invention the switch apertures are oriented downwardly to provide protection from moisture for the control switches. Since the rear canopy and the electronic control package do not rotate, the switches remain protected from the elements no matter the orientation of the front canopy and housing assembly.

Other objects, features and advantages of the present invention will become apparent from the detailed description of the preferred embodiments herein below taken in conjunction with the attached drawing Figures.

BRIEF DESCRIPTION OF THE DRAWING FIGURES

DETAILED DESCRIPTION OF THE PREFERRED EMBODIMENT(S)

Figure 1:
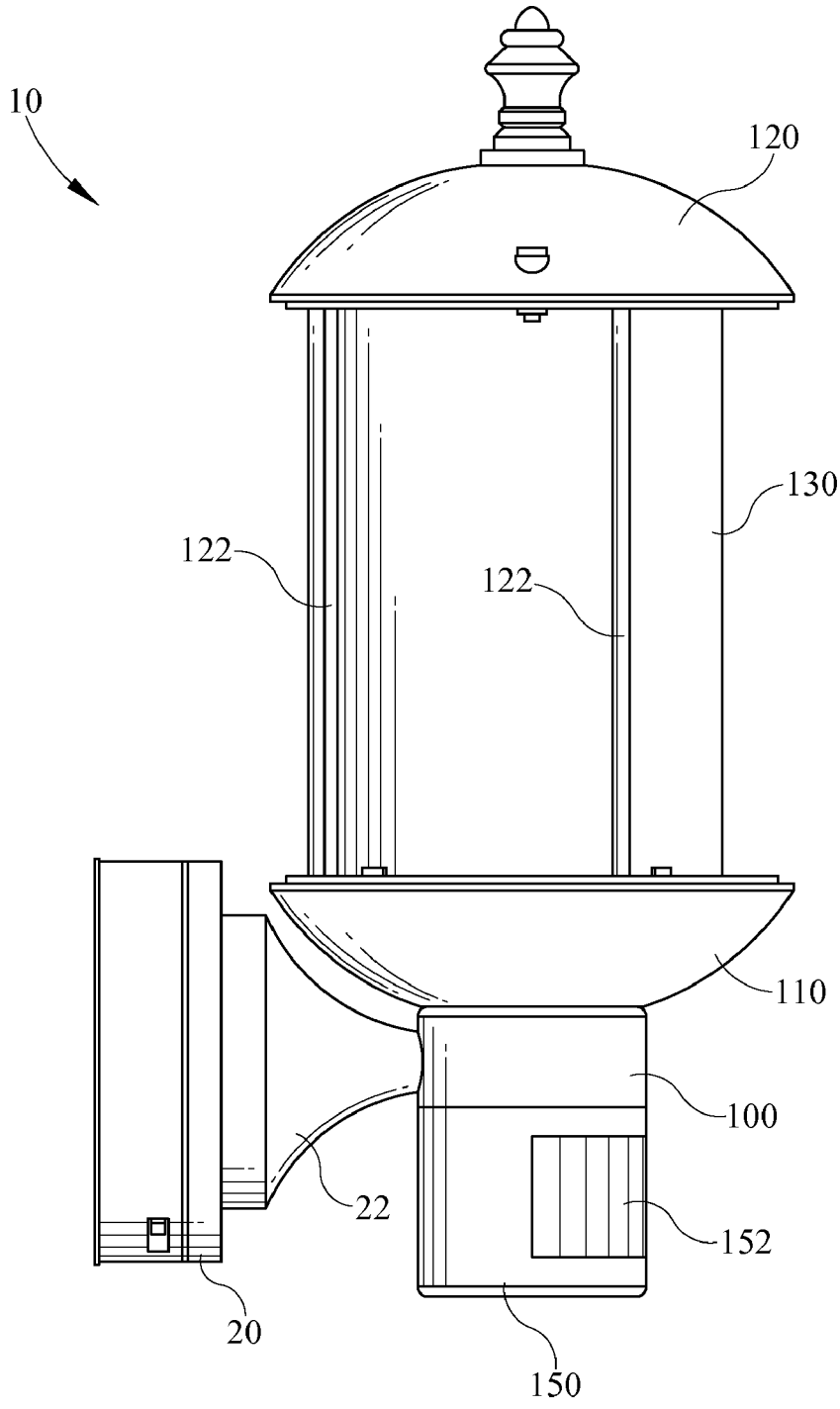
FIG. 1 is a side elevation view of a lighting fixture assembly in accordance with one embodiment of the present invention.
Figure 2:
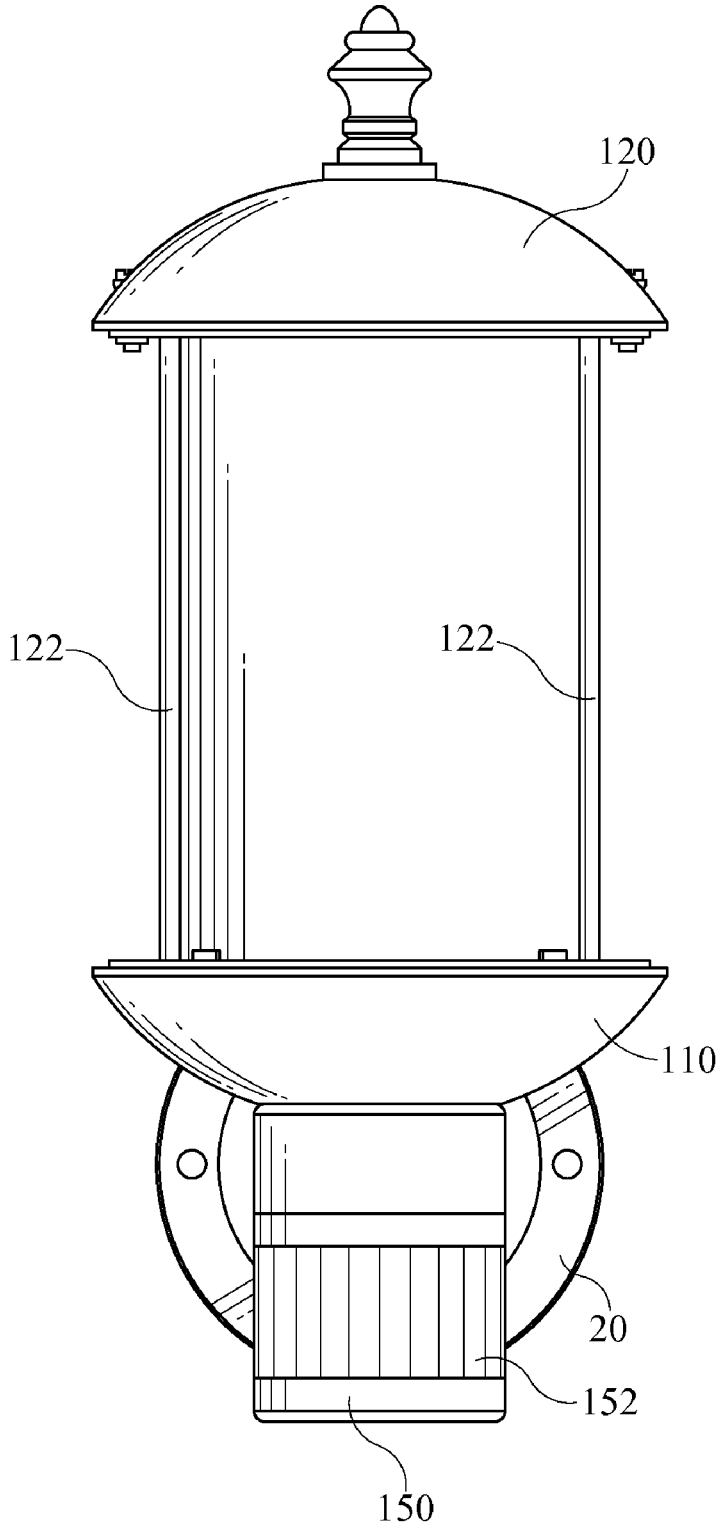
FIG. 2 is a front elevation view of a lighting fixture assembly in accordance with one embodiment of the present invention.

Referring now to the drawing Figures and in accordance with a preferred constructed embodiment of the present invention, a lighting fixture 10 capable of being mounted to a structure in a plurality of orientations includes a mounting assembly 20 and a lamp housing assembly 100 that is rotatably secured to mounting assembly 20.

Mounting assembly 20, as best seen in FIGS. 1, 2, 5, and 6, comprises a front canopy 22 and a rear canopy 40 that are shaped to mate at annular surface 42 of rear canopy to provide protection for the other components of mounting assembly 20 as well as provide a continuous exterior appearance for mounting assembly 20. Front canopy 22 is generally frusto-conical in shape and further includes a central aperture 24 therein for routing power and control wiring therethrough to their termination points in lamp housing assembly 100. One of ordinary skill in the art will recognize that a variety of shapes and surface appearances may be employed for both front canopy 22 and rear canopy 40 without departing from the scope of the present invention.

Figure 6:
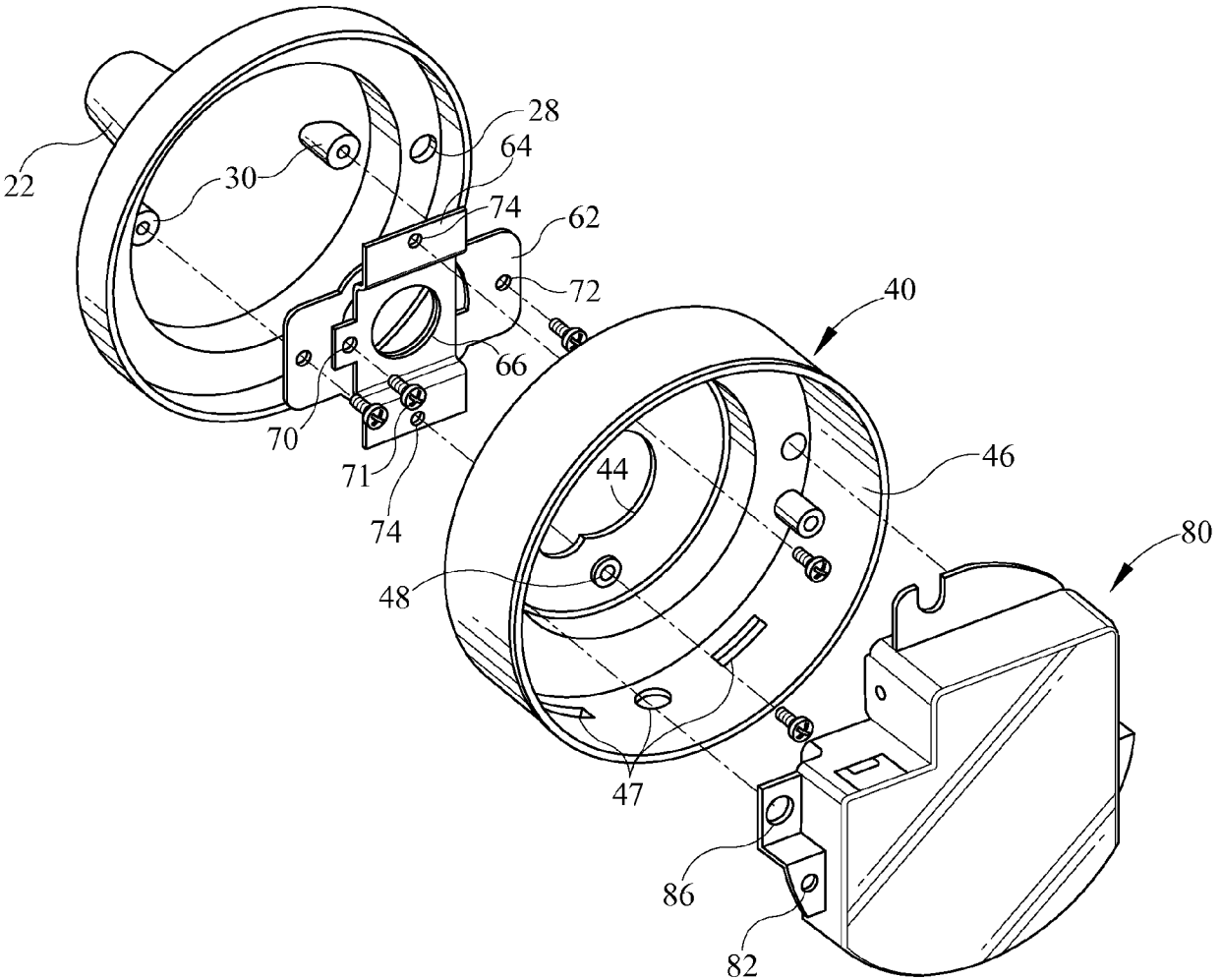
FIG. 6 is an exploded perspective view of a wall mount assembly in accordance with one embodiment of the present invention.

Front canopy 22 further includes an exterior flange 26 through which a plurality of apertures 28 are located to accept a plurality of fasteners for securing the front 22 and rear 40 canopies to a mounting bracket (not shown). As best seen in FIG. 6, front canopy 22 may also include a plurality of recessed female screw threads 30 for accepting screws or other fasteners as discussed further herein below.

Rear canopy 40 also comprises a central aperture 44 for routing wiring therethrough and includes a recessed interior portion 46 that accepts an electronic control assembly 80 therein to provide protection from the elements for the various electronic components required to operate lighting fixture 10. This feature of the invention permits a manufacturer to produce a modular electronic control assembly 80 that is readily secured to, and protected by canopy 40. Rear canopy 40 may further include a switch aperture 47, or a plurality thereof, through which a control switch or switches from an electronic control assembly 80 may be inserted for access. Switch aperture 47 is located in rear canopy 40 such that aperture 47 is positioned generally downwardly when mounting assembly 20 is installed. This feature of the invention protects electronic switches and controls from moisture and the elements when fixture 10 is mounted outside.

Figure 5:
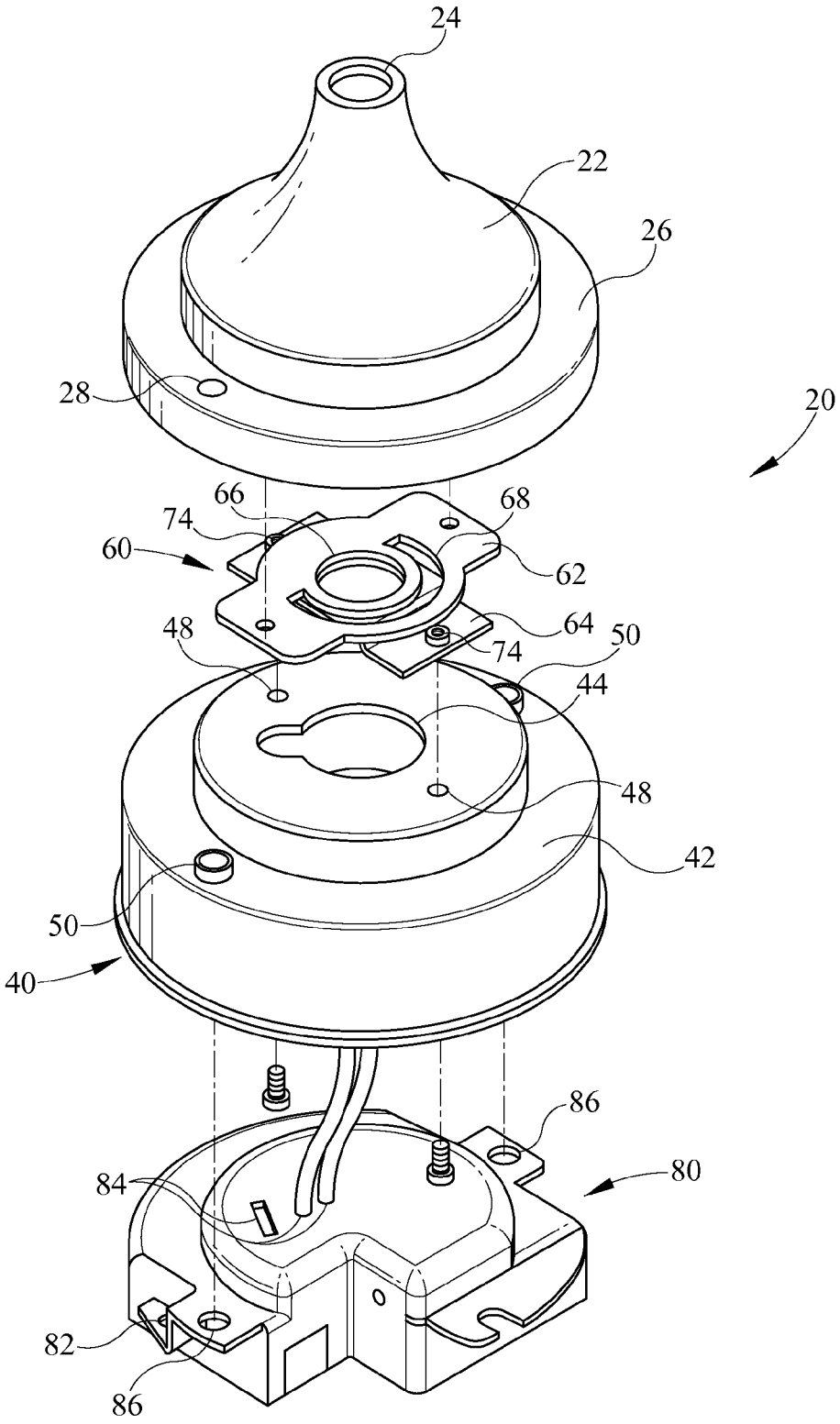
FIG. 5 is an exploded perspective view of a wall mount assembly in accordance with one embodiment of the present invention.

As shown in FIGS. 5 and 6, control assembly 80 includes a plurality of apertures 82 for accepting a plurality of fasteners for securing control assembly 80 to rear canopy 40. Furthermore, control assembly 80 may include a plurality of wiring slots 84 to permit ingress and egress of power and control wiring to electronic controls assembly 80.

Additionally, wall mount assembly 20 includes a rotating bracket 60 comprising two plates 62 and 64, each having an aperture 66 therein, that are capable of relative rotation with respect to each other. Plates 62 and 64 are positioned together such that their apertures 66 are substantially concentric, thence crimped together proximate the circumference of apertures 66 such that plates 62 and 64 are rotatable with respect to each other, yet inseparable.

Plate 62 further comprises an arcuate groove 68 located outwardly of aperture 66 and extending approximately 180° degrees around aperture 66. Plate 64 may also comprises a stop screw aperture 70, shown in FIG. 6, through which a stop screw is inserted or threaded to engage arcuate groove 68. As will be discussed in greater detail below, when a stop screw is inserted through aperture 70, it engages arcuate groove 68 such that rotation of front canopy 22 is inhibited at the points where the stop screw 71 meets the ends of arcuate groove 68.

Rotating bracket 60 plate 62 further includes a pair of spaced apertures 72 through which fasteners, such as a screws, may be inserted to engage threads 30 of front canopy 22, thereby securing front canopy 22 to rotating bracket 60. Similarly, plate 64 comprises a pair of spaced apertures 74 that are arranged to be generally concentric with a pair of spaced threaded apertures 48 in rear canopy 40. Plate 64 is secured to rear canopy 40 by insertion of a plurality of screws through spaced apertures 48 to engage threaded apertures 74. Thus both front and rear canopies 22 and 40 respectively are secured to each other via rotating bracket 60 such that front canopy 40 and rear canopy 22 are rotatable with respect to each other.

Electronic control assembly 80 is then positioned inside recessed interior 46 of rear canopy 40 to complete mounting assembly 20. Additionally, a pair of screw-type fasteners may be inserted through a conventional mounting bracket (not shown) may engage apertures 86 of control assembly 80, aperture 46 of rear canopy 40 and apertures 28 of front canopy 22 to secure mounting assembly 20 to a mounting surface. These fasteners may be engaged by a decorative nut or the like where they protrude through aperture 28 of front canopy 22. The decorative nuts are then simply removed to rotate front canopy 22 and consequently a lamp housing assembly 100 secured thereto.

Referring now to FIGS. 1-4 a lamp housing assembly 100 includes a motion sensor assembly 150, a bottom cover assembly 110, and a top cover assembly 120. Bottom cover assembly 110 is secured to top cover assembly 120 by means of an integral frame 122 including a flange 124 that secures frame 122 to bottom cover assembly 110 with a plurality of fasteners 126. One of ordinary skill in the art will recognize that top and bottom cover assemblies 110 and 120 can be secured to lamp housing assembly using a variety of different fastening arrangements without departing from the scope of the present invention.

Motion sensor assembly 150 is secured to bottom cover assembly 110 and also to front canopy 22 of mounting assembly 20. Motion sensor assembly may comprise a Fresnel lens 152 that both covers a concomitant motion sensor and helps focus radiation thereto. A variety of commercially available motion sensors may be incorporated in the sensor assembly 150 of the present invention without departing from the scope thereof. By positioning motion sensor assembly 150 and Fresnel lens 152 on housing assembly 100 proximate the axis of rotation of front canopy 22, the vertical position of motion sensor assembly 150 does not appreciably change when housing assembly 100 is rotated, given that the axis of rotation of the assembly 100 is around an axis through aperture 24 of front canopy 22. Since lamp housing assembly 100 is secured to front canopy 22, and since front canopy 22 is prohibited from over-rotation by operation of the stop screw engaging arcuate groove 68, lamp housing 100 is prohibited from rotating more than 180 degrees from an initial position.

Accordingly, motion sensor assembly 150 will remain in a position to detect motion within a tailored field of view no matter the orientation of lamp housing 100 since its vertical position is not greatly changed in any orientation. In operation, lamp housing assembly 100 may be oriented upwardly (FIGS. 1 and 2) or downwardly (FIGS. 3 and 4) as desired for a given product installation.

Figure 3:
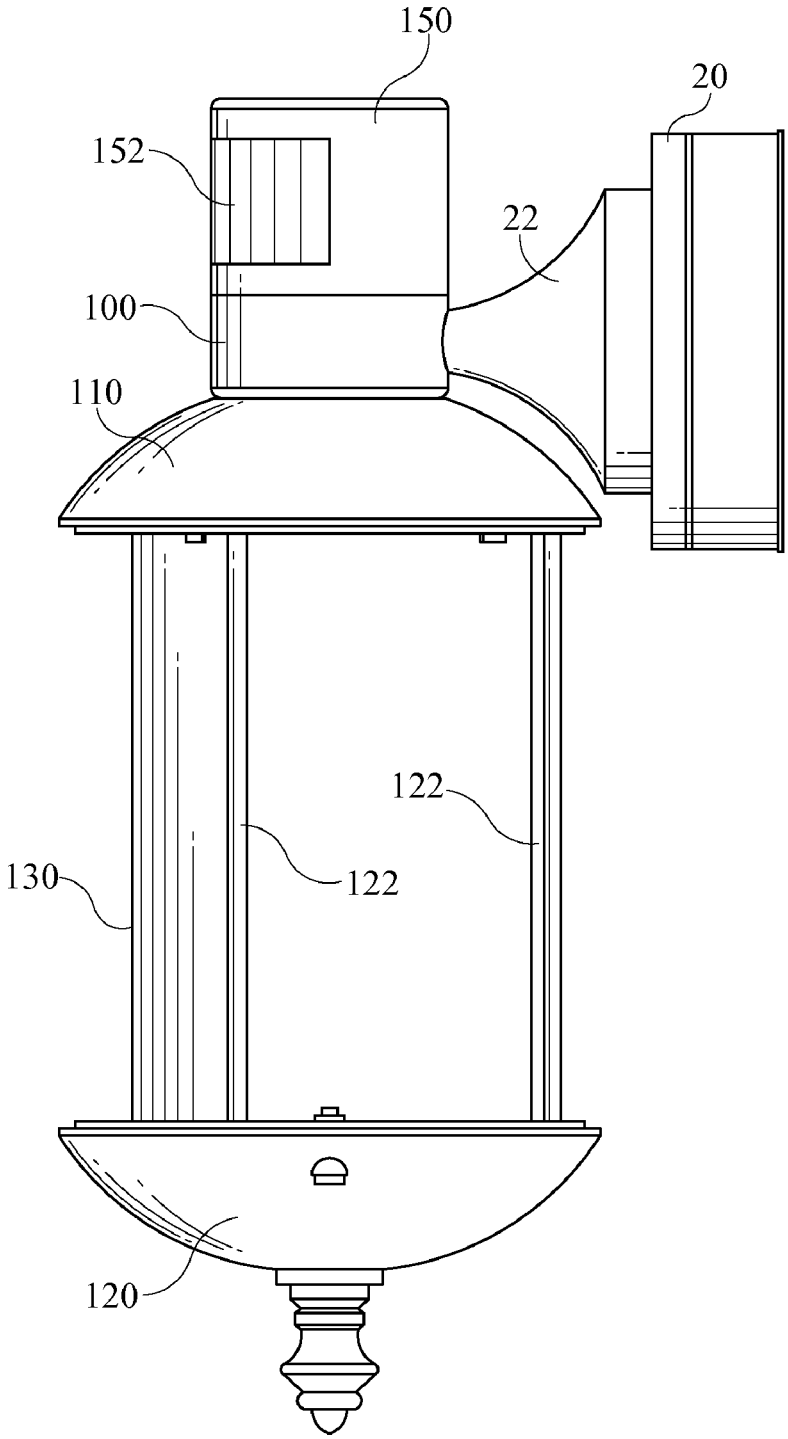
FIG. 3 is a front elevation view of a lighting fixture assembly in accordance with one embodiment of the present invention.
Figure 3A:
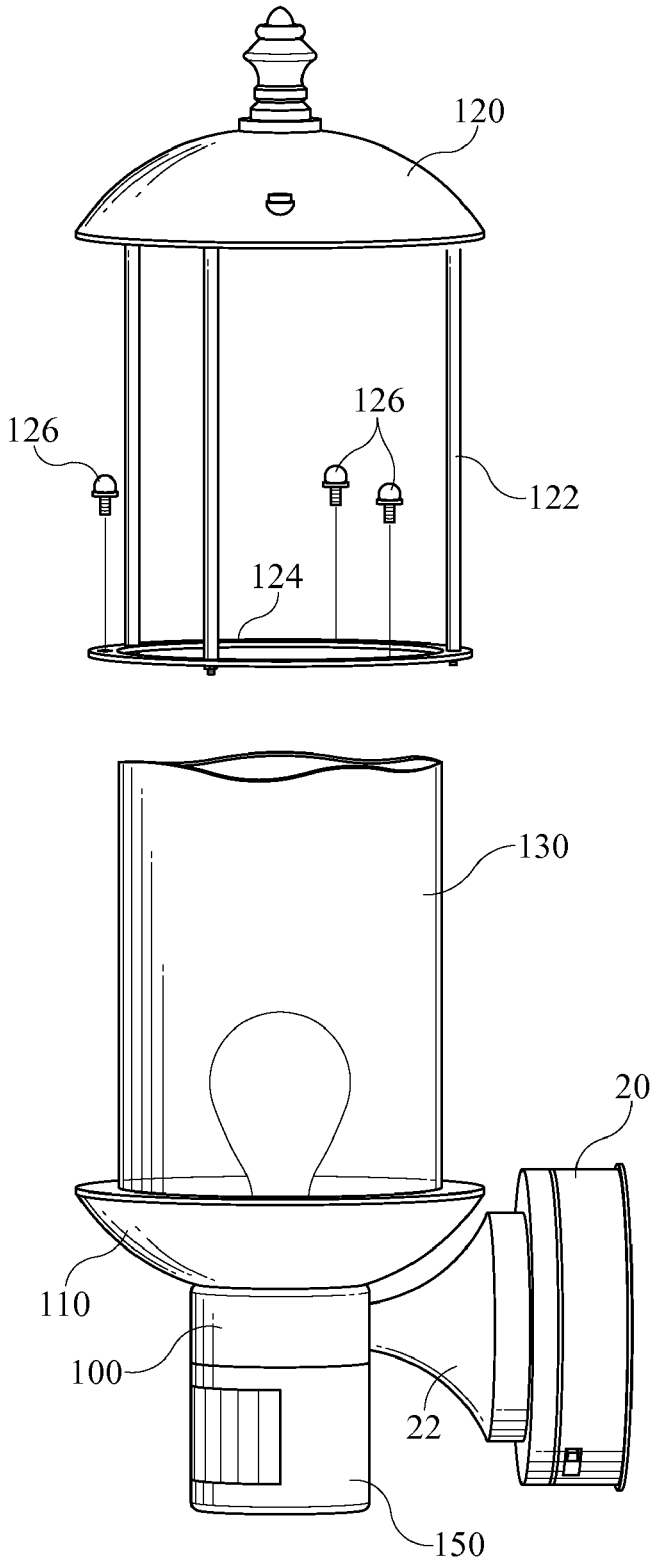
FIG. 3A is a partially exploded front elevation view of a lighting fixture assembly in accordance with one embodiment of the present invention.
Figure 4:
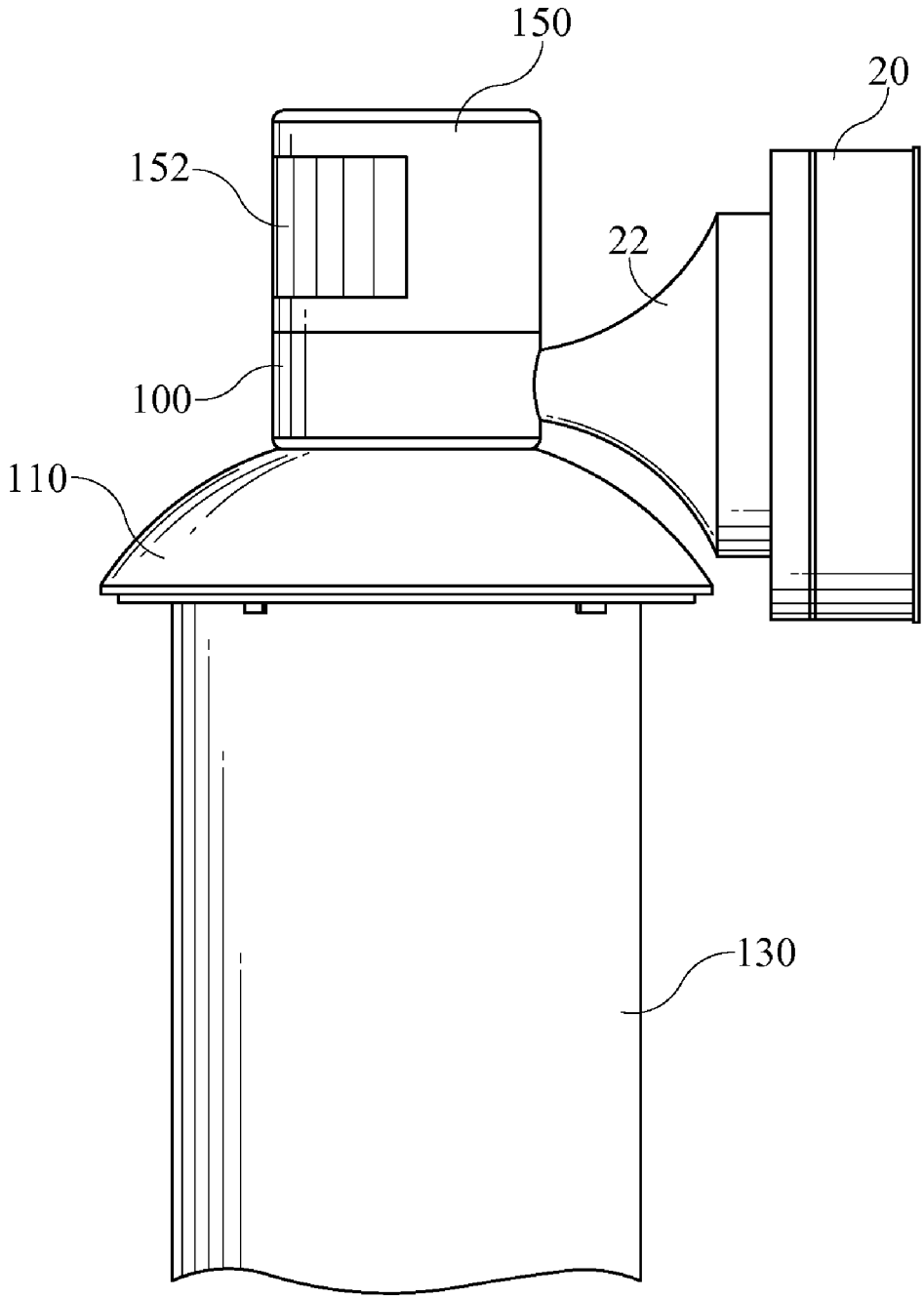
FIG. 4 is a front elevation view of a lighting fixture assembly in accordance with one embodiment of the present invention.

As best seen in FIGS. 3A and 4, lamp housing 100 may be oriented such that top cover assembly 120 is below bottom cover assembly 110. In this orientation, top cover assembly 120 and frame 122 may be removed from housing assembly 100 without removal of a shade 130 that is otherwise secured to bottom cover assembly 110.

The present invention thus provides a lighting fixture 10 that may be oriented upwardly or downwardly, or anywhere in between by simple rotation of the fixture without concern for over-rotation due to the construction of rotating bracket 60. This feature of the present invention protects power and control wiring that must be routed through mounting assembly 20 into lamp housing 100 since the wiring can never be rotated more than 180 degrees. Front canopy 22 of mounting assembly 20 provides for rotation of lamp housing assembly 100, while electronics assembly 80 remains stationary and protected within rear canopy 40.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

The invention claimed is:

1. A lighting fixture capable of mounting in a plurality of orientations comprising:

a wall mount assembly having a front canopy rotatable secured to a rear canopy; and a lamp housing assembly capable of a plurality of orientations secured to said rotatable front canopy and capable of rotation with the front canopy a lamp housing assembly having a bottom cover assembly and a top cover assembly for enclosing a lamp shade a removable frame securing said bottom cover assembly to said top cover assembly, whereby said top cover assembly may be removed from said lamp housing assembly.

2. The lighting fixture of claim 1 further including a motion detector which rotates as the lamp housing rotates.

3. A lighting fixture capable of mounting in a plurality of orientations comprising:

a wall mount assembly having a front canopy rotatably secured to a rear canopy; and a lamp housing assembly capable of a plurality of orientations secured to said rotatable front canopy and capable of rotation therewith a rotating bracket having first and second plates capable of relative rotational motion;

said first plate secured to said front canopy; and said second plate secured to said rear canopy to enable rotational motion between said front and rear canopies.

4. A lighting fixture capable of mounting in a plurality of orientations as claimed in claim 3 further comprising:

a pair of central apertures in said first and second plates, said apertures being substantially concentric for routing wiring therethrough.

5. A lighting fixture capable of mounting in a plurality of orientations as claimed in claim 3 comprising:

an arcuate groove in said first plate; and an aperture in said second plate having a stop screw therethrough, said stop screw engaging said arcuate groove to limit the rotation of said first plate with respect to said second plate.

6. A lighting fixture capable of mounting in a plurality of orientations as claimed in claim 5 wherein the rear canopy has a central aperture therein configured to route wiring therethrough.

7. A lighting fixture capable of mounting in a plurality of orientations as claimed in claim 5 wherein the rear canopy has a recessed interior portion therein configured to accept an electronic control assembly having a control switch protruding therefrom.

8. A lighting fixture capable of mounting in a plurality of orientations as claimed in claim 7 wherein the rear canopy has a switch aperture therein located at a bottom portion thereof for access to said control switch when said fixture is mounted.

9. A lighting fixture capable of mounting in a plurality of orientations comprising:

a wall mount assembly having a front canopy rotatably secured to a rear canopy configured to be fixed relative to a mount support when the fixture is mounted, the front canopy configured to extend perpendicularly from the mount support when the lighting fixture is mounted on the mount support;

a lamp housing assembly capable of a plurality of orientations secured to said rotatable front canopy, the lamp housing capable of a plurality of orientations and capable of 180° rotation;

an electronic control assembly disposed within the rear canopy, the rear canopy having at least one switch access opening at the bottom thereof such that exposure of the electronic control assembly to environmental conditions external to the lighting fixture does not change as the lamp housing assembly and front canopy rotate.

10. A lighting fixture capable of mounting in a plurality of orientations as claimed in claim 9 wherein the front canopy has a central aperture which is configured to route wiring to said lamp housing assembly.

11. A lighting fixture capable of mounting in a plurality of orientations as claimed in claim 9 wherein the lamp housing assembly has a bottom cover assembly and a top cover assembly which encloses a lamp shade.

12. A lighting fixture capable of mounting in a plurality of orientations as claimed in claim 9 wherein the rear canopy has a central aperture therein configured to route wiring therethrough.

13. A lighting fixture capable of mounting in a plurality of orientations as claimed in claim 9 further comprising:

a motion sensor assembly secured to said lamp housing assembly and capable of rotation with the lamp housing.

14. A lighting fixture capable of mounting in a plurality of orientations as claimed in claim 13 wherein a Fresnel lens is secured to said motion sensor assembly which lens focuses radiation to the motion sensor.

15. A lighting fixture capable of mounting in a plurality of orientations as claimed in claim 13 wherein said motion sensor assembly is positioned proximate the axis of rotation of said front canopy.

16. The fixture of claim 9 wherein the electronic control assembly is disposed in fixed relation to the wall mount assembly.

17. A lighting fixture comprising:

a motion sensor assembly which detects motion, the motion sensor assembly having a field of view that extends outwardly from the lighting fixture;

a front canopy rotatably secured to a rear canopy and an axis of rotation extending through the front canopy and the rear canopy, said front and rear canopies each having a central aperture therein configured to route wiring therethrough, said rear canopy configured to be fixedly mounted to a structure, the front canopy being rotatable about the axis of rotation; and a lamp housing secured to said front canopy and capable of rotation with the front canopy about the axis of rotation, the motion sensor assembly mounted at about the axis of rotation of the front canopy such that the rotation of the lamp housing and front canopy about the axis of rotation does not substantially change the field of view of the motion sensor assembly when the lamp housing is rotated around the axis of rotation.

18. A lighting fixture having a motion sensor assembly for detecting motion as claimed in claim 17 wherein said front and rear canopies are fixedly secured to a mounting bracket.

19. A lighting fixture having a motion sensor assembly for detecting motion as claimed in claim 17 wherein said front canopy comprises a flange portion that mates with said rear canopy to provide a consistent fixture appearance.

20. A lighting fixture having a motion sensor assembly for detecting motion as claimed in claim 17 wherein the lamp housing has a top cover and a bottom cover, said top cover being removable from said lamp housing.

21. A lighting fixture having a motion sensor assembly for detecting motion as claimed in claim 17 wherein said rear canopy encloses an electronic control assembly coupled to said motion sensor.

22. A lighting fixture having a motion sensor assembly for detecting motion as claimed in claim 21 wherein said electronic control assembly and said rear canopy remain stationary while said front canopy is rotated.

23. The fixture of claim 17 wherein the motion sensor assembly does not move substantially within a vertical direction as the lamp assembly and the front canopy are rotated.

24. A lighting fixture having a motion sensor assembly for detecting motion comprising:

a front canopy rotatably secured to a rear canopy said front and rear canopies each having a central aperture therein for routing wiring therethrough, said rear canopy fixedly mounted to a structure;

a lamp housing secured to said front canopy and capable of rotation therewith; and a rotating bracket secured to said front canopy and to said rear canopy to permit relative rotation therebetween.

25. The lighting fixture of claim 24 wherein the lighting fixture further includes a motion detector configured to rotate when the front canopy is rotated.

26. A lighting fixture having a motion sensor assembly for detecting motion as claimed in claim 24 wherein the rotating bracket has a rotation stop which limits rotation between said front and said rear canopies.

27. A lighting fixture having a motion sensor assembly for detecting motion as claimed in claim 26 wherein said front canopy, said rear canopy and said rotating bracket each comprise an aperture therein for routing wiring to said lamp housing.

28. A lighting fixture having a motion sensor assembly for detecting motion as claimed in claim 26 wherein an arcuate groove in said rotating bracket and a stop pin engages said groove and limits rotation of said front canopy.

29. A lighting fixture having a motion sensor assembly for detecting motion as claimed in claim 28 wherein said rotating bracket permits one-hundred eighty degrees of rotation.

30. A lighting fixture having a motion sensor assembly for detecting motion as claimed in claim 29 further comprising an electronic control assembly having a control switch protruding therefrom, the rear canopy having a switch aperture therein for accepting said control switch, said switch aperture oriented generally downwardly when said fixture is mounted to a surface.

* * * * *

UNITED STATES PATENT AND TRADEMARK OFFICE

CERTIFICATE OF CORRECTION

PATENT NO. : 7,641,366 B1
APPLICATION NO. : 11/677810
DATED : January 5, 2010
INVENTOR(S) : Gregory L. Sibalich and Lam Kai Kuong It is certified that error appears in the above-identified patent and that said Letters Patent is hereby corrected as shown below:

Claim 1, Column 5, Line 15 -- Change "rotatable" to -- rotatably, --; and

Claim 24, Column 7, Line 22 -- Change "canopy said" to -- canopy, said --.

Signed and Sealed this

Twenty-seventh Day of April, 2010

David J. Kappos

David J. Kappos
*Director of the United States Patent and Trademark Office*